United States Patent [19]

Brown

[11] 4,428,149

[45] Jan. 31, 1984

[54] TOY BALLOON CLOSURE DEVICE

[76] Inventor: Paul L. Brown, 982 Lakeview Way, Redwood City, Calif. 94062

[21] Appl. No.: 390,335

[22] Filed: Jun. 21, 1982

[51] Int. Cl.[3] ..... A63H 3/06

[52] U.S. Cl. ..... 46/90; 46/88

[58] Field of Search ..... 46/90, 86, 87, 88; 24/30.55

[56] References Cited

U.S. PATENT DOCUMENTS

| | | | |
|---|---|---|---|
| 2,568,389 | 9/1951 | Elliot | 46/90 |
| 2,840,948 | 12/1956 | Stickley | 46/32 |
| 3,267,604 | 8/1966 | Goldsmith | 46/90 |

*Primary Examiner*—Robert A. Hafer
*Assistant Examiner*—Perry Knutson
*Attorney, Agent, or Firm*—Arlington C. White

[57] ABSTRACT

A toy balloon closure device of tubular configuration having a longitudinal slot therein extending the full length of the same and including an interior divider separating it into a first compartment and a second compartment; said divider having a central hole therein having a diameter greater than the width of said slot, a passage extending from said hole to said slot; said first compartment being adapted to receive the lips under tension of an inflated toy balloon through said slot and said second compartment being adapted to receive the twisted stem of said toy balloon through said slot whereby the tension induced by the normal elasticity of the rubberized balloon material and said tension enhanced by the twisting of the stem of the inflated balloon causing said device to seat firmly against the inflated balloon with sufficient supportive strength to allow the balloon to be held in a horizontal, vertical or angular position. Connectors, extenders or couplers detachably secured to said tubular body afford the presentation of a plurality of toy balloons in variable attractive patterns.

5 Claims, 16 Drawing Figures

TOY BALLOON CLOSURE DEVICE

Applicant is not aware of any closure member for toy balloons similar to the tubular configuration of applicant's present invention herein disclosed and claimed other than, generally, the toy balloon holder which is disclosed and claimed in U.S. Pat. No. 3,267,604, granted on Aug. 23, 1966, to Willis H. Goldsmith, wherein there is disclosed and claimed a toy balloon holder consisting of a flared end tube means for receiving the end of an inflated toy balloon, a hollow longitudinal means for receiving the lip and stem of such a balloon, after which the balloon is inflated and the stem twisted, and wherein said twisted stem is then partially wound around the exterior longitudinal portion of the device and the lips secured in a slot thereby sealing said balloon, and said device having a counterbalancing means for substantially counterbalancing the weight of the balloon as either a support means for supporting the combination of said holder means and said counterbalancing means which is a substantially different structure from applicant's device in that the Goldsmith structure includes a flared end as well as a counterbalancing means.

A primary object of my invention is to provide a toy balloon closure device which affords a sealing of an inflated toy balloon.

Another object of my invention is to provide a toy balloon closure device of the indicated nature which is additionally characterized by simplicity and an inexpensiveness of manufacture.

Another important object of the invention is to provide a toy balloon closure device which is additionally characterized by its capacity of presenting a variety of attractive patterns of a plurality of toy balloons.

Another object of the invention is to provide a toy balloon closure device to which two balloons can be attached and sealed one at each end of the closure.

Still another object of the invention is to provide a toy balloon closure device a modification of which with use of attachments is characterized by its capability of creating a plurality of action toys and stationary decorative toys.

Other objects of the invention, together with some of the advantageous features thereof, will appear from the following description of a preferred embodiment of the invention which is illustrated in the accompanying drawings wherein the best mode of construction and manufacturing the invention are shown. It is to be understood that the appended claims are intended to cover the embodiment illustrated as well as variations thereof within the scope and purview of the invention.

Referring to the drawings.

In its best mode, the closure device for an inflated toy balloon of my present invention preferably comprises a tubular body having a longitudinal slot therein, an interior divider separating the same into a pair of compartments for receiving the lips and twisted stem of an inflated balloon under sufficient supportive tensional strength to enable the closure device to hold the balloon firmly in a horizontal, vertical or angular position.

Figure 1:
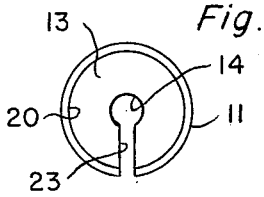
FIG. 1 is a top plan view of a preferred embodiment of the invention.
Figure 4:
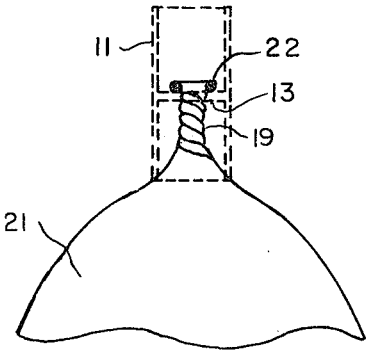
FIG. 4 is a fragmentary front elevational view, partly in compartmentalized dashed lines of the closure device showing the twisted stem and the lips of a toy balloon in place.

In accordance with my invention, I provide a relatively short body 11 which preferably is made to tubular configuration and which is formed with a longitudinally extending slot 12 therein extending the full length thereof. Interiorly of the body 11 is a transverse divider 13 having a central hole 14 therein; said divider 13 serves to separate the body 11 into a pair of inner compartments 17 and 18 of which the compartment 17 receives the twisted stem 19 of a toy balloon 21 through the longitudinal slot 12 of the body 11, and the compartment 18 receives the balloon lip 22 under tension for seating on the central hole 14 of the divider 13. A passage 23 is formed on the closure device leading from the central hole 14 of the divider to the longitudinal slot 12, as clearly shown in FIG. 1 of the annexed drawings. It is to be observed that the twisted stem 19 of a toy balloon is fed not only through the longitudinal slot 12 of my improved closure device 11 but also is fed through the passage 23 to bring the lips 22 of the inflated balloon into seated engagement with the interior divider 13 at the hole 14 thereof.

Figure 5:
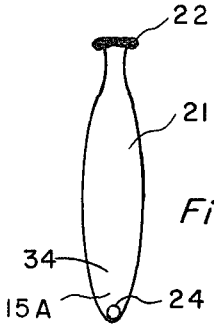
FIG. 5 is a front elevational view of an uninflated toy balloon showing a plastic pellet resting on the interior bottom of the balloon.
Figure 6:
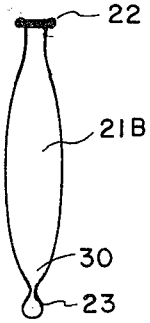
FIG. 6 is a front elevational view of an uninflated toy balloon with an integral nodule at its bottom end.
Figure 7:
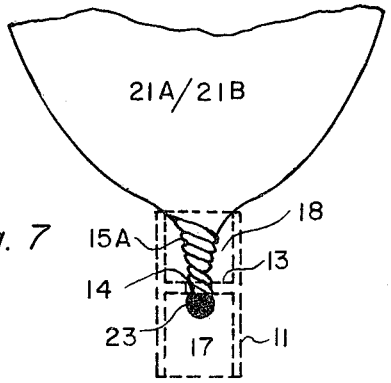
FIG. 7 is a fragmentary front elevational view, partly in compartmentalized dashed lines of the closure device, showing the twist normally given to the stem of the balloon to seal the balloon but with the interiorly positioned pellet or the integral nodule employed in lieu of the balloon lip to secure the device under tension against the inflated body of the balloon.
Figure 11:
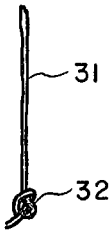
FIG. 11 is a fragmentary elevational view of a support element showing the knot at the end of the element for securing the element to the closure device.

In FIGS. 5, 6 and 7 of the annexed drawings, I have illustrated means by which my improved balloon closure device can be detachably secured to the bottom end of an inflated balloon. As indicated in FIG. 5, a pellet 24 whose diameter is larger than the diameter of the central hole 14 of the divider 13 of the closure tubular body 11, is dropped inside of an uninflated balloon 21A and the bottom end 34 of the balloon is flexed outward and twisted. The twisted portion 15A of the balloon is fed through slot 12 of the closure device and into compartment 18 thereof, thus seating the enclosed pellet 24 under tension on the central hole 14 of the divider 13 in compartment 17. Similarly, the integrally fabricated nodule 23 is flexed outwardly, and the tip end area 30 of the balloon 21B is twisted with said twisted portion 15A fed through slot 12 of the closure device and into compartment 18, and the integrally fabricated nodule 23, under tension, is seated upon the central hole 14 of the divider 13 in compartment 17.

Figure 8:
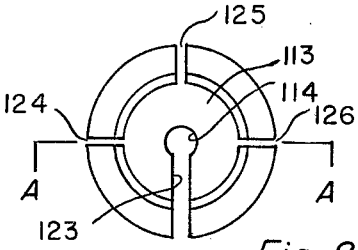
FIG. 8 is a sectional view taken along the line A—A of FIG. 9 of a modified embodiment of the invention.
Figure 2:
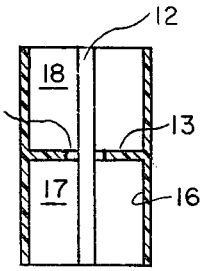
FIG. 2 is a front sectional elevational view of the preferred embodiment of the invention.
Figure 9:
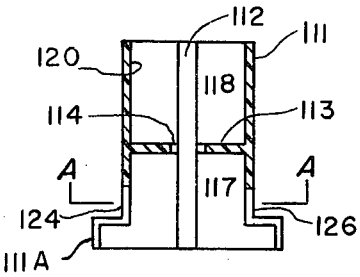
FIG. 9 is a front sectional elevational view taken along the line A—A of FIG. 8 of a modified embodiment of the invention.
Figure 3:
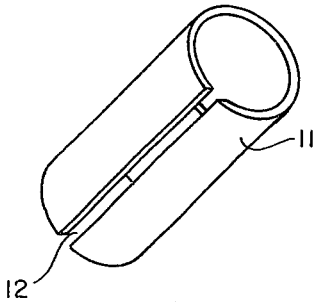
FIG. 3 is a perspective view of the preferred embodiment of the invention.
Figure 10:
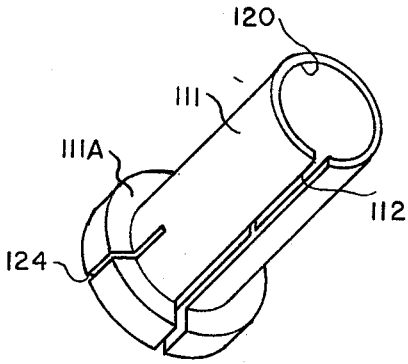
FIG. 10 is a perspective view of the modified embodiment shown in FIGS. 8 and 9.

A modified embodiment of my toy balloon closure device is shown in FIGS. 8, 9 and 10 of the annexed drawings wherein a flange 111A is provided on a end of the short tubular body 111 which likewise has a longitudinally extending slot 112 therein which extends the full extremity of the body interior of the short body 111. I provide a transverse divider 113 for separating the body into a pair of compartments 117 and 118 with an interior circular wall 120, and I preferably form a central hole 114 therein for aiding in holding the lips of the twisted stem of the toy balloon under tension when inserted into the compartments 117 and 118 through the longitudinal slot 112; of which compartment 117 receives the twisted stem of a toy balloon through the longitudinal slot 112 of the tubular body 111, and the compartment 118 receives the balloon lips under tension for seating on the central hole 114 of the divider 113. A passage 123 is formed in the closure device leading from the central hole 114 of the divider 113 to the longitudinal slot 112, as clearly shown in FIG. 8 of the drawings to assist in feeding lips of the toy balloon to a seat against the hole 114 of the divider under tension with the inflated body portion of the balloon supported by the flange 111A of the closure device. It is to be understood that the flange of the closure device need not be a part of the modification as it is not a necessary element thereof inasmuch as the toy balloon in its inflated condition can be held by the divider 113 of the body 111 with the lips and twisted stem of the inflated balloon under tension for holding the balloon in a longitudinal, vertical or angular position.

Figure 12:
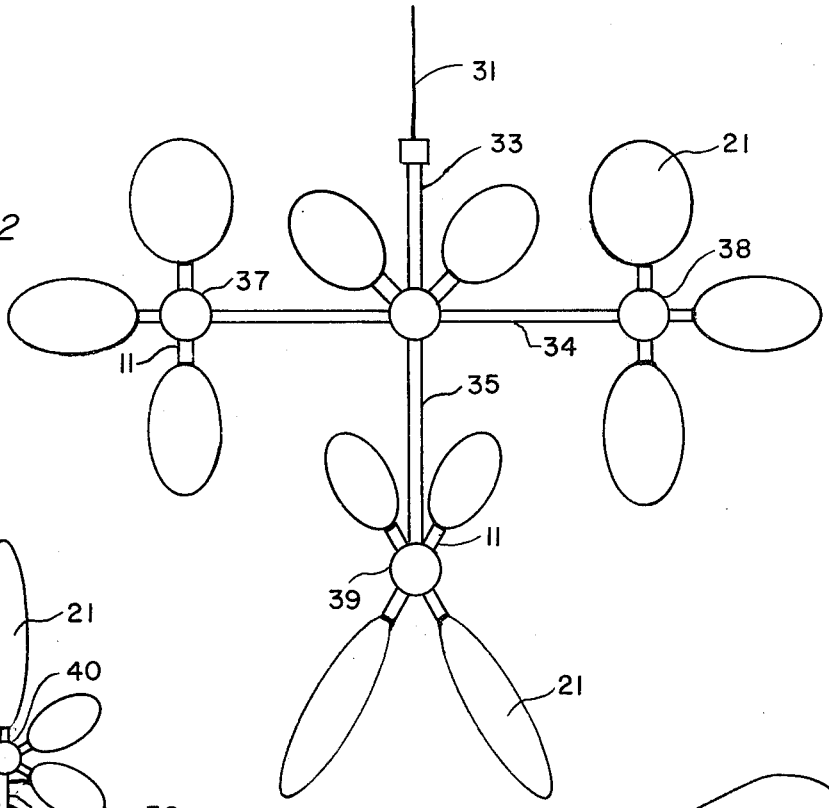
FIG. 12 is a front elevational view of a plurality of toy balloons connected by couplers and extenders and hung as an ornamental mobile by the support element of FIG. 11.
Figure 13:
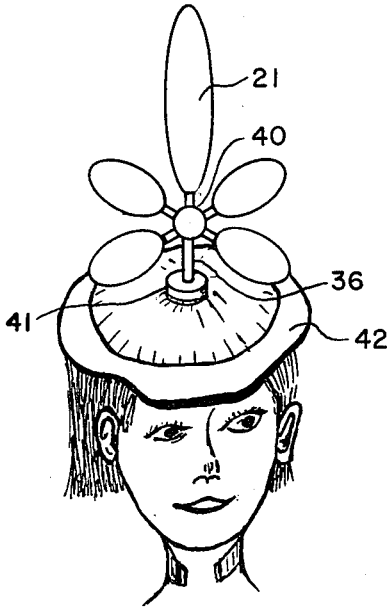
FIG. 13 is an elevational view showing how by use of the preferred embodiment of the closure device and the adhesive backed coupling shown in FIG. 14 an attractive arrangement of balloons can adorn a person's hat for uniqueness.

With particular reference to FIGS. 12 to 16, inclusive, of the annexed drawings, it will be observed that with the use of a number of different detachably secured extenders and couplers a plurality of inflated toy balloons can be arranged and presented in a variety of attractive patterns for wall and table decorations and can be hung as mobiles using simply a piece of cord or string 31 having a knot 32 on one end thereof; said knot 32 being passed through the longitudinal slot 112 and passage 123 to be seated firmly at the central hole 114 of the divider 113 or, as shown in FIG. 12, simply attached to a coupling element which in the case shown in the drawing is coupled to an extender 33. For example, variable patterns can be provided using tubular extensions 33, 34 and 35, as well as couplers 37, 38 and 39. Moreover, a somewhat bizarre design can be accomplished by attaching an assortment of toy balloons to a coupler 40 which is attached to an extender 36 which in turn is attached to an adhesive-backed coupler 41, and the entire assembly mounted adhesively to a person,s hat 42, or an appropriate adhesively attached assembly can be placed upon a person,s body or on a wall or ceiling or the like.

Figure 15:
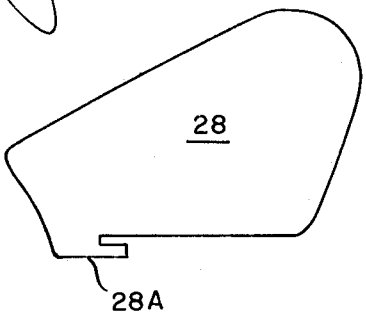
FIG. 15 is an elevational view of a fin-like attachment which can be detachably secured to the closure device.
Figure 14:
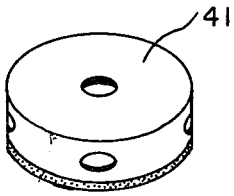
FIG. 14 is a perspective view of an adhesive backed coupling to facilitate the placement of a balloon arrangement on the wall, mirror or any convenient place such as a hat of a person as shown in FIG. 13.
Figure 16:
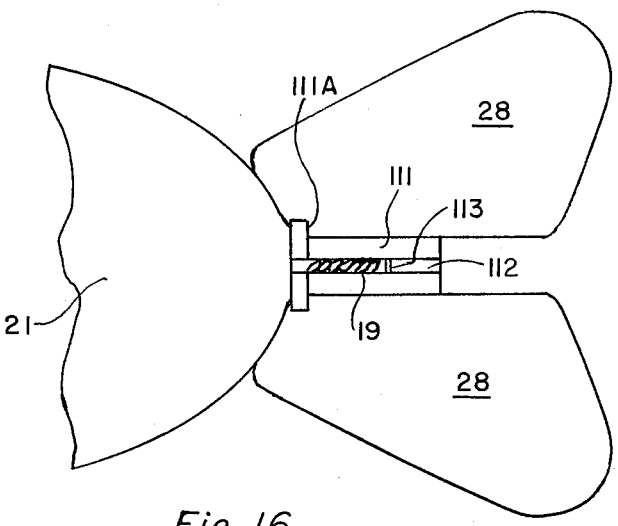
FIG. 16 is an elevational view of two of the aforementioned fin-like attachments secured to a modified embodiment of the closure device which in turn is attached to either end of a toy balloon.

As illustrated in FIG. 16, a plurality of inflated toy balloons can be made presentable by using fin-like attachments which, as shown in FIG. 15, carry a flange 28A thereon for detachably fastening said fin-like attachments 28 to opposite side slots 124 and 126.

I claim:

1. A toy balloon closure device comprising a tubular body having a longitudinal extending slot therein, an interior divider separating said tubular body into a pair of compartments; said divider having a central hole therein, one of said compartments receiving the twisted stem of an inflated toy balloon under tension through said slot, and the other of said pair of compartments receiving the lips of the inflated toy balloon under tension against the hole of said divider whereby to seal the inflated balloon and to hold the same in a horizontal, vertical or angular position.

2. A toy balloon closure device as set forth in claim 1 wherein said longitudinal slot extends the full length of said tubular body to facilitate the slippage of said twisted stem and said lips of said inflated toy balloon through said slot.

3. A toy balloon closure device as set forth in claim 1 wherein said tubular body has a passage therein extending from said central hole of said divider to said slot for guiding the lips of an inflated toy balloon to seat upon said central hole of said divider and to impart increased tension to said twisted stem of an inflated balloon and increased holding strength to said tubular body.

4. A toy balloon closure device as set forth in claim 1 wherein said tubular body is detachably secured to the twisted stem and lips of an inflated toy balloon and is replaceable with respect thereto, and wherein said pair of compartments are reusable for holding the twisted stem and lips of an inflatable toy balloon but which is deflatable whereby a series of variable patterns of horizontally, vertically or angularly positioned inflated toy ballons are replaceably presentable.

5. A toy balloon closure as set forth in claim 1 wherein said tubular body is detachably secured to extenders and couplers of one form or another for providing variable patterns of a plurality of inflated toy balloons held in horizontal, vertical or angular positions.

* * * * *